US006205962B1

(12) United States Patent
Berry, Jr.

(10) Patent No.: US 6,205,962 B1
(45) Date of Patent: Mar. 27, 2001

(54) TWO-CYCLE INTERNAL COMBUSTION ENGINE WITH ENHANCED LUBRICATION

(76) Inventor: William H. Berry, Jr., 7232 Sherrills Ford Rd., Sherrills Ford, NC (US) 28673

( * ) Notice: Subject to any disclaimer, the term of this patent is extended or adjusted under 35 U.S.C. 154(b) by 0 days.

(21) Appl. No.: 09/433,397

(22) Filed: Nov. 3, 1999

(51) Int. Cl.[7] ..... F02B 33/12
(52) U.S. Cl. ..... 123/73 A; 123/193.6
(58) Field of Search ..... 123/74 A, 74 AA, 123/193.4, 193.6, 196 R, 73 A

(56) References Cited

U.S. PATENT DOCUMENTS

| | | | |
|---|---|---|---|
| 4,736,676 | 4/1988 | Taylor . | |
| 4,829,940 | 5/1989 | Okazaki et al. . | |
| 4,860,699 | 8/1989 | Rocklein . | |
| 5,072,699 | 12/1991 | Pien . | |
| 5,396,867 | 3/1995 | Ito et al. . | |
| 5,582,155 | 12/1996 | Knopp . | |
| 6,050,234 * | 4/2000 | Hannoosh | 123/193.1 |

OTHER PUBLICATIONS

Husqvarna Chain Saws; Husqvarna; pp. 6, 26 and 27.

* cited by examiner

*Primary Examiner*—Willis R. Wolfe
*Assistant Examiner*—Katrina B. Harris
(74) *Attorney, Agent, or Firm*—Adams, Schwartz & Evans, P.A.

(57) ABSTRACT

A gasoline internal combustion engine, including an engine block having a cylinder, fuel intake port and exhaust port therein. A piston is mounted in the cylinder for two-cycle, reciprocating movement therein, and includes an annular piston head and a cylindrical piston skirt, a connecting rod rotatably-mounted by a top end thereof to a piston roller bearing carried on a piston pin of the piston, and by a bottom end of the connecting rod to a crankshaft for outputting power from the reciprocating piston, the crankshaft mounted on a pair of spaced-apart crankshaft roller bearing assemblies, and an array of holes extending through the piston skirt for drawing gasoline from an opposing fuel intake side of the piston to the exhaust side of the piston on the downstroke of the piston to lubricate the exhaust side of the piston and cylinder without the mixture of engine oil with the gasoline.

11 Claims, 3 Drawing Sheets

TWO-CYCLE INTERNAL COMBUSTION ENGINE WITH ENHANCED LUBRICATION

TECHNICAL FIELD AND BACKGROUND OF THE INVENTION

This invention relates to two-cycle internal combustion engines. Such engines are used in a very wide variety of applications, for example, lawn mowers, string trimmers, snow and leafblowers, personal watercraft such as "jet-skis", motorcycles, boats and chain saws. Such engines are typically lubricated by means of oil mixed with raw gasoline in some fixed ratio, for example 50 parts of gasoline to 1 part oil instead of an oil-filled crankcase, as in four-cycle engines. The term "two-cycle" is actually a shortened version of "two-stroke cycle", and refers to the fact that each cycle of the engine is completed in two strokes of the piston—one up and one down. The engine must be designed so that the combustion chamber can be supplied with a fresh charge of fuel when the piston is in the extreme outward position.

In most two-cycle engines, valves are replaced by ports in the cylinder, through which fuel is drawn into the cylinder and exhaust gases are expelled. These engines are called "piston-ported" engines. One cylinder port, the exhaust port, leads to the atmosphere and permits exhaust gases to be expelled from the combustion chamber by the pressure within the cylinder. The other cylinder port, the fuel intake port, opens from a bypass to the crankcase, and through it a slightly compressed charge of fuel is delivered to the cylinder when the piston uncovers the port. In some types of two-cycle engines, the gas is compressed in the crankcase by the piston, but in others an external compressor of a piston or rotary type is employed. The principles of this invention have application not only to piston-ported engines but also to reed-valve engines, and to both air-cooled and water-cooled two-cycle engines.

The fuel induction side of the piston is adequately lubricated by the intake of outside air and fuel vapor. On the other hand, the exhaust side of the piston is exposed to extremely high friction which can easily cause scoring or other damage to the piston and cylinder walls on the exhaust side. This is the limiting factor in lubricating two-cycle engines, and the oil in the oil/gasoline mixture is intended to provide lubrication primarily to the exhaust side of the piston and cylinder, as well as the piston pin and crankshaft.

Mixture of lubricating oil with gasoline in such engines creates a number of problems. The lubricating oil is only partially burned during the ignition and combustion. The remaining oil is exhausted as a blue/gray exhaust stream which has an foul odor, creates air pollution, and coats environmental surfaces with which it comes into contact. Some amount of the oil remains in the engine and eventually fouls the spark plug, cylinder walls and piston components. The oil component of the gasoline/oil mixture is also quite expensive in relation to the ratio used, and adds an inordinate amount to the overall fuel costs. These disadvantages have caused more expensive, heavier and lower efficiency four-cycle engines to be used for many applications where a two-cycle engine could otherwise be used.

Experimentation by applicant has shown that conventional two-cycle engines can be run for extended periods of time with a gasoline-only fuel without damage to the fuel induction side of the piston or cylinder. Raw gasoline has a high degree of lubricity in its liquid and gaseous state, and thus by itself can provide adequate lubrication to those areas with which it comes in contact. Damage in such two-cycle engines is principally to the exhaust side of the engine, and is caused by lack of lubrication. Thus, if additional gasoline-only lubrication could be supplied to the exhaust side of the engine and to the top of the inside of the piston without introduction of lubricating oil into the gasoline, two-cycle engines would run cleaner and more efficiently.

SUMMARY OF THE INVENTION

Therefore, it is an object of the invention to provide a two-cycle internal combustion engine which operates without lubricating oil being mixed with the gasoline fuel.

It is another object of the invention to provide a two-cycle internal combustion engine which operates without discharging lubricating oil into the environment.

It is another object of the invention to provide a two-cycle internal combustion engine which operates cleanly.

It is another object of the invention to provide a two-cycle internal combustion engine which operates at a temperature lower than conventional two-cycle internal combustion engines. These and other objects of the present invention are achieved in the preferred embodiments disclosed below by providing an air-cooled or water-cooled, two-cycle gasoline internal combustion engine, comprising an engine block having a cylinder, fuel intake port and exhaust port therein, and a piston mounted in the cylinder for two-cycle, reciprocating movement therein. The piston includes an annular piston head and a cylindrical piston skirt, a connecting rod rotatably-mounted by a top end thereof to a piston roller bearing carried on a piston pin of the piston, and by a bottom end to a crankshaft for outputting power from the reciprocating piston. The crankshaft is mounted on a pair of spaced-apart crankshaft roller bearing assemblies. An array of holes extends through the piston skirt for drawing gasoline from an opposing fuel intake side of the piston to the exhaust side of the piston on the downstroke of the piston to lubricate the exhaust side of the piston and cylinder without the mixture of engine oil with the gasoline.

According to one preferred embodiment of the invention, the array of holes comprises a plurality of spaced-apart holes interconnected by grooves in the piston skirt.

According to another preferred embodiment of the invention, the array of holes comprises a first plurality of holes positioned so as to not communicate with the exhaust port; and a second plurality of holes positioned as to communicate with the exhaust port.

According to another preferred embodiment of the invention, the piston includes a groove in the piston head and extending radially between the exhaust side of the piston head and the center of the piston head for burning excess gas.

Preferably, the piston is forged aluminum and is chrome-plated.

Preferably, the exhaust port is polished.

According to one preferred embodiment of the invention, the first plurality of holes comprises two holes, and the second plurality of holes comprises two holes.

According to another preferred embodiment of the invention, the top end of the crankshaft and the bottom end of the crankshaft each include an annular groove encircling at least a portion thereof for allowing more gasoline to contact the roller bearings.

According to yet another preferred embodiment of the invention, the engine is a single cylinder engine.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
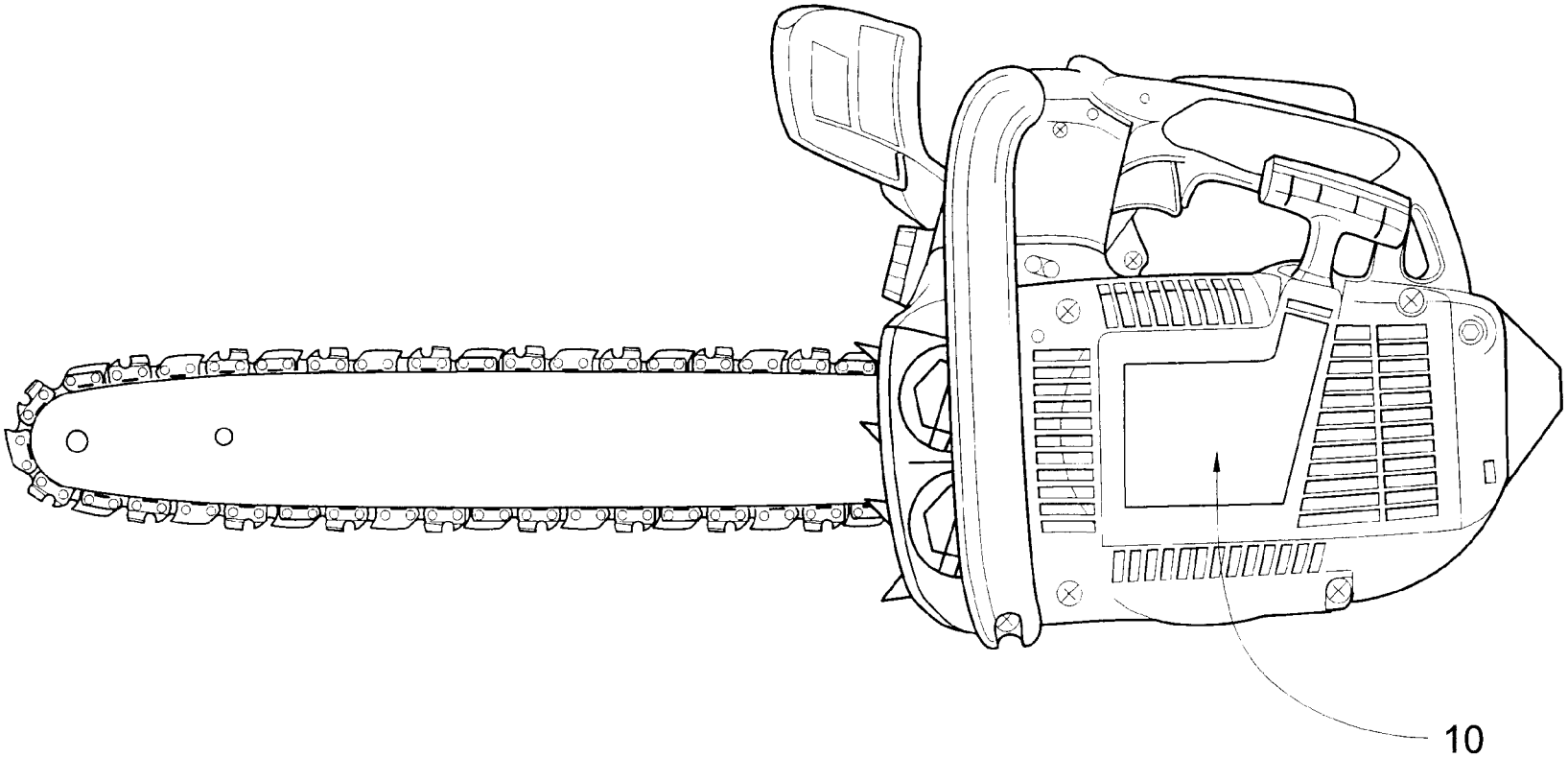
FIG. 1 is a side elevation of a two-cycle internal combustion engine in a typical use application to power a chain saw.

Referring now specifically to the drawings, a two-cycle gasoline internal combustion engine according to the present invention is illustrated in FIG. 1 and indicated generally at reference numeral 10. The engine 10 is shown as used in a typical application to power a chain saw. The principles of the invention have application in many different uses and can be used on two-cycle engines of many different types and sizes.

Figure 2:
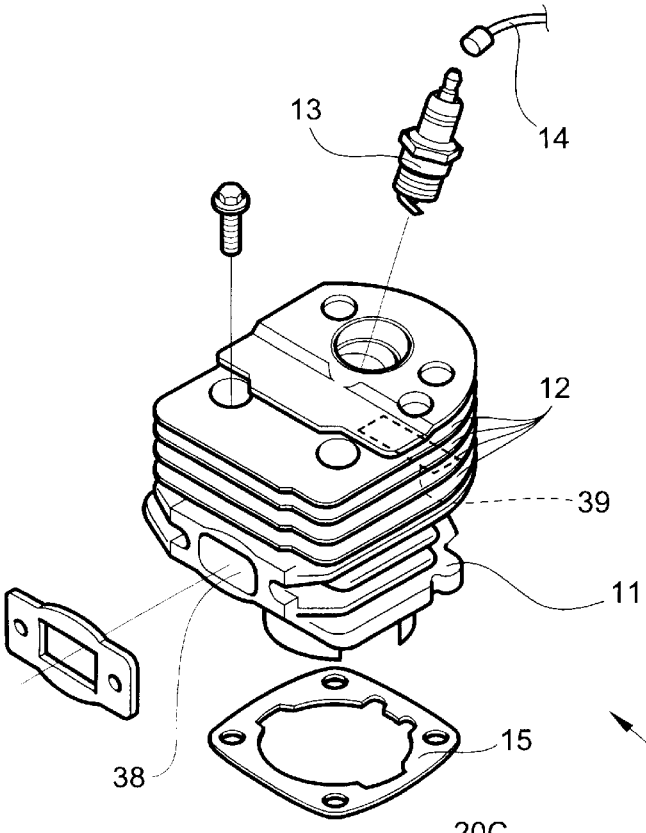
FIG. 2 is a partial exploded view of the engine block portion of the two-cycle gasoline internal combustion engine shown in FIG. 1.
Figure 3:
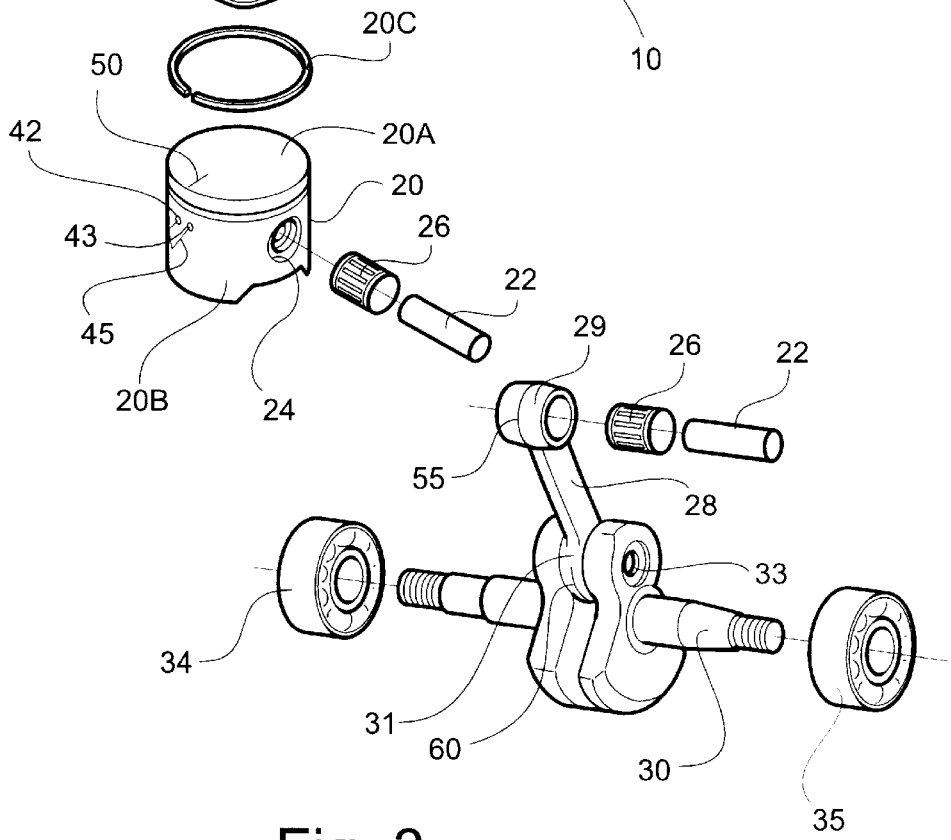
FIG. 3 is a partial exploded view of the crankshaft and piston pin portion of the engine shown in FIG. 1.

Relevant parts of the engine 10 are shown in greater detail in FIGS. 2 and 3, and include an engine cylinder block 11, cooling fins 12, a spark plug 13 with an electrical lead 14, and a cylinder gasket 15. A piston 20 is mounted in a conventional manner in the cylinder block 11 for reciprocating movement. Piston 20 defines an annular piston head 20A and an integrally-formed cylindrical skirt 20B. Skirt 20B receives a piston ring 20C which engages the inner cylindrical walls of the cylinder block 11. Piston 20 also includes a piston pin 22 which is mounted in a piston pin hole 24. A roller bearing 26 is carried inside the piston 20 on the piston pin 22. The piston 20 is preferably forged aluminum and chrome-plated.

As is shown in FIG. 3, a connecting rod 28 is mounted on the roller bearing 26 of the piston pin 22 by means of an annular piston pin collar 29 at one end and to a crankshaft 30 by means of an annular crankshaft collar 31 at the other end, which carries a crankcase pin 33 on which is mounted a roller bearing (not shown). The crankshaft 30 is mounted for rotation by means of a pair of roller bearings 34, 35 in the crankcase (not shown).

The cylinder block 11 includes an exhaust port 38 and a fuel intake port 39 on the opposite side of the cylinder block 11 from the exhaust port 38. In keeping with conventional two-cycle engine technology, the piston 20 reciprocates in the cylinder block 11 between positions whereby fuel is drawn into the fuel intake port 39 and enters the combustion chamber of the cylinder block 11 on the compression admission stroke. The inclosed volume of the cylinder block 11, on the blind, or top, side of the piston 20 defines a combustion chamber.

Figure 4:
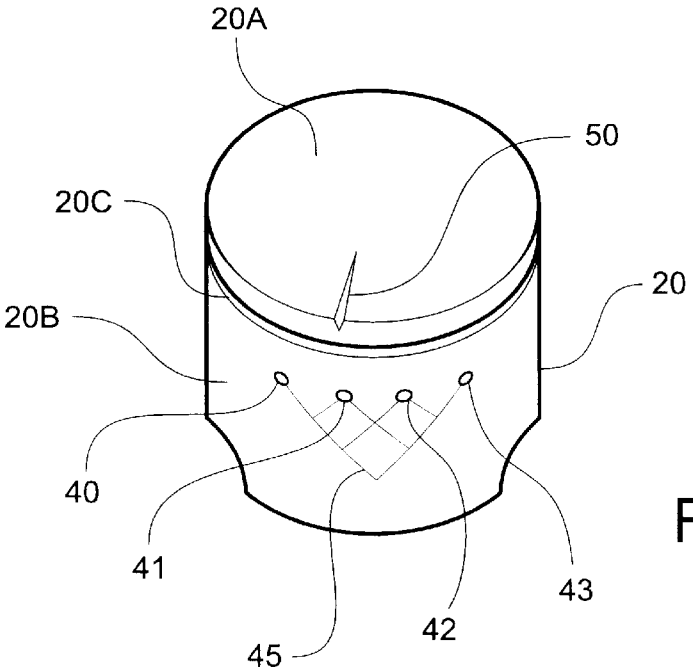
FIG. 4 is a perspective view of the exhaust side of the piston.

Referring now to FIG. 4, an array of holes 40,41,42 and 43 are formed in the skirt 20B of the piston 20. These holes are interconnected by a multi-segmented groove 45 formed in the wall of the piston skirt 20B but not extending therethrough. The pattern of the groove 45 as shown in FIG. 4 not only interconnects the holes 40–43 but also extends downwardly from the holes 40–43 and thereby disperses gasoline across the face of the exhaust side of the piston skirt 20B.

Figure 5:
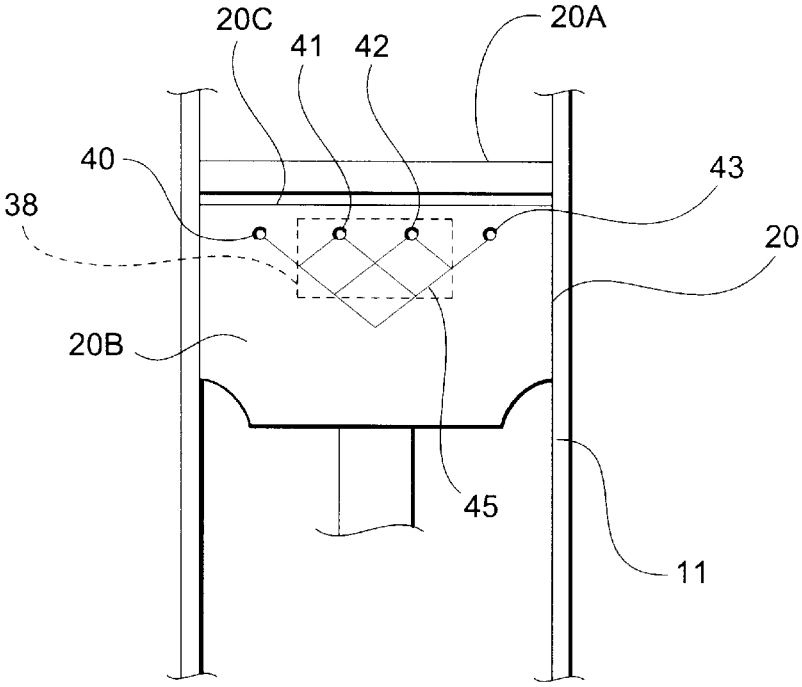
FIG. 5 is a side elevation view of the exhaust side of the piston showing the arrangement of holes and grooves therein with the perimeter of the exhaust port superimposed thereon.

As is shown in FIG. 5, holes 41 and 42 are positioned so that they are within the perimeter of the exhaust port during at least a portion of each stroke of piston 20, while holes 40 and 43 are positioned so as not to be in communication with the exhaust port 38 during any phase of operation.

During operation, gasoline fuel in the crankcase which is pressurized during the combustion stroke is delivered to the exhaust side of the piston 20 through the holes 40–43. The groove 45 and the holes 40–43 permit the fuel to pass through from the inside to the outside and thereby spread across the surface of the exhaust side of the piston 20, thus providing lubrication to the exhaust side of the piston 20. A by-product of this additional lubrication is that the engine runs somewhat cooler than conventional engines, since heat-generating friction is reduced. In experiments, an engine in accordance with the invention ran on a gasoline-only fuel for 10 minutes at maximum rpm at a temperature of 254° C., in contrast to a typical temperature under similar conditions of 288° C.–294° C.

The holes 41, 42, being within the perimeter of the exhaust port 38 during at least a portion of the cycle, promote freer flow of gasoline through these holes than through the holes 40 and 43, thus directing the gasoline more directly into the proximity of the piston pin 22 and bearing 26, providing additional lubrication to the piston pin 22 and bearing 26.

Referring again to FIG. 4, the piston 20 optionally includes a tapered groove 50 formed in the piston head 20A. Groove 50 communicates with the edge of the piston head 20A in the area above the holes 40–43 in the exhaust side of the piston skirt 20B, and extends radially-inwardly towards the center of the piston head 20A. Groove 50 becomes progressively shallower as it progresses radially-inwardly. In the illustrative preferred embodiment set out in this application with a 45 mm diameter piston, the groove 50 is approximately 4 mm wide and 4 mm deep at the edge of the piston head 20A and extends to the center by a distance of approximately 12 mm. Groove 50 functions to cause exhaust gases to flow towards the exhaust port 38 marginally earlier in the exhaust portion of the cycle and thus decreases back pressure in the engine, thus improving engine efficiency. When the piston head 20A reaches the exhaust port 38, exhaust gases have already begun flowing into the exhaust port 38 through the groove 50. In effect, the timing of the exhaust cycle of the engine is advanced very slightly.

Other modifications also improve the operation of the engine 10. As is shown in FIG. 3, an annular groove 55 is formed in the piston pin collar 29, and an annular groove 60 is formed in the crankcase collar 31. These grooves 55 and 60 form reservoirs for gasoline in the crankcase and thus receive some of the additional lubricating gasoline directed into this area by the flow through the holes 41 and 42.

While the above features define the principal elements of the invention, a preferred embodiment for purposes of illustration is set out below:

| Engine Type: | One cylinder, air-cooled, two-stroke cycle, reciprocating, gasoline-fueled internal combustion engine. |
|---|---|
| Engine displacement: | 51 $cm^3$ |
| Piston (20) diameter: | 45 mm |
| Hole (41,42) diameter | 1.3 mm |
| Hole ((40, 43) diameter | 1.8 mm |
| Groove (45) depth: | .5 mm |

-continued

| Engine Type: | One cylinder, air-cooled, two-stroke cycle, reciprocating, gasoline-fueled internal combustion engine. |
|---|---|
| Groove (45) width: | 3 mm |
| Groove (50) depth at edge: | 3 mm |
| Groove (50) width: | 3 mm |
| Groove (60) depth: | .5 mm |
| Groove (60) width: | 3 mm |

Other considerations for optimum performance include retarding the ignition between 3 and 4 degrees less than typical on such an engine, which will provide less negative crankshaft force. It has also been determined that the thickness of the piston head 20A need be no more than approximately 4 mm thick. This reduces the weight of the piston 20 and produces further efficiencies, including less mass to move to create a given amount of energy, and greater heat transfer.

A two-cycle internal combustion engine is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A two-cycle gasoline internal combustion engine, comprising:

(a) an engine block having a cylinder, fuel intake port and exhaust port therein;

(b) a piston mounted in the cylinder for two-cycle, reciprocating movement therein, said piston including an annular piston head and a cylindrical piston skirt;

(c) a connecting rod rotatably-mounted by a top end thereof to a piston roller bearing carried on a piston pin of the piston, and by a bottom end to a crankshaft for outputting power from the reciprocating piston, said crankshaft mounted on a pair of spaced-apart crankshaft roller bearing assemblies; and (d) an array of holes extending through the piston skirt for drawing gasoline from an opposing fuel intake side of the piston to the exhaust side of the piston on the downstroke of the piston to lubricate the exhaust side of the piston and cylinder without the mixture of engine oil with the gasoline.

2. An internal combustion engine according to claim 1, wherein said exhaust port is polished.

3. An internal combustion engine according to claim 1, wherein the top end of the crankshaft and the bottom end of the crankshaft each include an annular groove encircling at least a portion thereof for allowing more gasoline to contact the roller bearings.

4. An internal combustion engine according to claim 1, wherein said engine is a single cylinder engine.

5. An internal combustion engine according to claim 1, wherein said engine is an air-cooled engine.

6. An internal combustion engine according to claim 1, and including a groove in the piston head and extending radially between the exhaust side of the piston head and the center of the piston head for burning excess gas.

7. An internal combustion engine according to claim 6, wherein the piston is forged aluminum.

8. An internal combustion engine according to claim 6, wherein said forged aluminum piston is chrome-plated.

9. An internal combustion engine according to claim 1, wherein said array of holes comprises a plurality of spaced-apart holes interconnected by grooves in the piston skirt.

10. An internal combustion engine according to claim 9, wherein said array of holes comprises:

(a) a first plurality of holes positioned so as to not communicate with the exhaust port; and (b) a second plurality of holes positioned as to communicate with the exhaust port.

11. An internal combustion engine according to claim 10, wherein said first plurality of holes comprises 2 holes, and said second plurality of holes comprises 2 holes.

* * * * *